US009359736B2

(12) United States Patent
Kanbara et al.

(10) Patent No.: US 9,359,736 B2
(45) Date of Patent: Jun. 7, 2016

(54) AUGER SNOW-REMOVING MACHINE

(71) Applicant: Honda Motor Co., Ltd., Tokyo (JP)

(72) Inventors: Fumiyoshi Kanbara, Wako (JP); Kouhei Matsuzawa, Wako (JP); Atsushi Moroi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 46 days.

(21) Appl. No.: 14/449,295

(22) Filed: Aug. 1, 2014

(65) Prior Publication Data

US 2015/0033590 A1 Feb. 5, 2015

(30) Foreign Application Priority Data

Aug. 2, 2013 (JP) ..... 2013-161650

(51) Int. Cl.
*E01H 5/09* (2006.01)

(52) U.S. Cl.
CPC ..... *E01H 5/098* (2013.01)

(58) Field of Classification Search
CPC ..... E01H 5/04; E01H 5/045; E01H 5/076; E01H 5/098; E01H 5/08
See application file for complete search history.

(56) References Cited

U.S. PATENT DOCUMENTS 6,453,583 B1 * 9/2002 Hanafusa ..... E01H 5/04 37/243
6,539,649 B2 * 4/2003 Sueshige ..... E01H 5/04 192/17 R
6,931,771 B1 * 8/2005 Liebl ..... E01H 5/045 37/248
2005/0241190 A1 * 11/2005 Kettering ..... E01H 5/098 37/258

FOREIGN PATENT DOCUMENTS

| | | |
|---|---|---|
| CH | 402037 | 11/1965 |
| JP | H06-158620 | 6/1994 |
| JP | 2004-360379 | 12/2004 |
| WO | 2012/094320 | 7/2012 |

OTHER PUBLICATIONS

European Search Report dated Nov. 6, 2014, 7 pages.

* cited by examiner

*Primary Examiner* — Jamie L McGowan
(74) *Attorney, Agent, or Firm* — Rankin, Hill & Clark LLP

(57) ABSTRACT

An auger snow-removing machine includes left and right forward rotation augers rotatable in a first direction during snow removal and left and right reverse rotation augers rotatable in a second direction opposite the first direction during the snow removal. The forward and reverse rotation augers are coaxially disposed in alignment in a width direction of an auger housing within the housing. Distal ends of the left forward rotation auger and the right reverse rotation auger have phases set to substantially simultaneously reach a lowermost location when the forward and reverse rotation augers rotate. Distal ends of the right forward rotation auger and the left reverse rotation auger have phases set to substantially simultaneously reach the lowermost location when the forward and reverse rotation augers rotate.

1 Claim, 4 Drawing Sheets

AUGER SNOW-REMOVING MACHINE

FIELD OF THE INVENTION

The present invention relates to an improvement in an auger of an auger snow-removing machine.

BACKGROUND OF THE INVENTION

Auger snow-removing machines collect snow using augers disposed at front parts of the machines and throw the collected snow via shooters to distant places using blowers, as the machines travel forward. A typical example of such auger snow-removing machines is disclosed in JP-A-2004-360379. The disclosed auger snow-removing machine includes forward rotation augers rotatable in a direction from an upper side of the augers toward a front lower side of the augers, and reverse rotation augers rotatable in a direction opposite to the direction of rotation of the forward rotation augers. The forward rotation augers and the reverse rotation augers are disposed on the same axis and aligned with one another in a width direction of an auger housing within the auger housing.

Left and right forward rotation augers have a rotational speed higher than a rotational speed of left and right reverse rotation augers. Due to this difference in the rotational speed, distal ends of the left and right forward rotation augers in the direction of rotation of the forward rotation augers and the distal ends of the left and right reverse rotation augers in the direction of rotation of the reverse rotation augers randomly or independently hit a surface of accumulated snow. This results in individual reaction forces being randomly or independently exerted on the respective augers, which adversely affects a running stability of the auger snow-removing machine. Thus, there is a room for improvement to enhance the running stability. Further, it is preferable that the reaction force exerted on the left and right forward rotation augers during snow removal is counterbalanced by the reaction force exerted on the left and right reverse rotation augers in order to enhance an efficiency of snow removing work.

SUMMARY OF THE INVENTION

It is an object of the present invention to provide an auger snow-moving machine having an enhanced running stability as well as an enhanced efficiency of snow removing work.

According to the present invention, there is provided an auger snow-removing machine comprising: left and right forward rotation augers rotatable in a direction from an upper side of the forward rotation augers toward a front lower side of the forward rotation augers during a snow-removing operation of the machine; left and right reverse rotation augers rotatable in a reverse direction opposite to the direction of rotation of the left and right forward rotation augers during the snow-removing operation; and an auger housing, the left and right forward rotation augers and the left and right reverse rotation augers being coaxially disposed and aligned with one another in a width direction of the auger housing within the auger housing, all of the left and right forward rotation augers and the left and right reverse rotation augers having the same rotational speed, the left and right forward rotation augers being located either inside or outside the left and right reverse rotation augers in the width direction of the auger housing, the left forward rotation auger having a distal end in the direction of rotation of the left and right forward rotation augers, the right reverse rotation auger having a distal end in the direction of rotation of the left and right reverse rotation augers, the distal end of the left forward rotation auger and the distal end of the right reverse rotation auger having phases set such that the distal end of the left forward rotation auger and the distal end of the right reverse rotation auger substantially simultaneously reach a lowermost location when the left forward rotation auger and the right reverse rotation auger rotate, and the right forward rotation auger having a distal end in the direction of rotation of the left and right forward rotation augers, the left reverse rotation auger having a distal end in the direction of rotation of the left and right reverse rotation augers, the distal end of the right forward rotation auger and the distal end of the left reverse rotation auger having phases set such that the distal end of the right forward rotation auger and the distal end of the left reverse rotation auger substantially simultaneously reach the lowermost location when the right forward rotation auger and the left reverse rotation auger rotate.

All of the augers have the same rotational speed. The left and right forward rotation augers are located either inside or outside the left and right reverse rotation augers in the width direction of the auger housing. The distal end of the left forward rotation auger in the direction of rotation of the left and right forward rotation augers and the distal end of the right reverse rotation auger in the reverse direction have the phases set such that the distal ends reach the lowermost location substantially at the same time when the left forward rotation auger and the right reverse rotation auger rotate. Thus, the distal end of the left forward rotation auger and the distal end of the right reverse rotation auger basically simultaneously hit a surface of accumulated snow. Therefore, a reaction force exerted on the left forward rotation auger during the snow-removing operation is counterbalanced by a reaction force exerted on the right reverse rotation auger.

The distal end of the right forward rotation auger in the direction of rotation of the left and right forward rotation augers and the distal end of the left reverse rotation auger in the reverse direction have the phases set such that the distal ends reach the lowermost location substantially at the same time when the right forward rotation auger and the left reverse rotation auger rotate. Thus, the distal end of the right forward rotation auger and the distal end of the left reverse rotation auger basically simultaneously hit the surface of accumulated snow. Therefore, a reaction force exerted on the right forward rotation auger during the snow-removing operation is counterbalanced by a reaction force exerted on the left reverse rotation auger.

The distal end of the right reverse rotation auger is the same in phase as the distal end of the left forward rotation auger while the distal end of the left reverse rotation auger is the same in phase as the distal end of the right forward rotation auger. As a result, it becomes possible to inhibit an "unruliness phenomenon", i.e., inhibit the auger housing or a body frame of the machine from frequently swaying up and down and/or from side to side due to individual reaction forces exerted on the respective augers during the snow-removing operation. Additionally, the left and right reverse rotation augers inhibit lifting phenomena of the left and right forward rotation augers. As a result, a running stability of the snow-removing machine and an efficiency of snow removing work can be enhanced.

Preferably, the snow-removing machine comprises a blower housing disposed behind the auger housing at a widthwise central portion of the auger housing, and a blower disposed inside the blower housing, the distal end of the right forward rotation auger having a phase shifted 90 degrees (or substantially 90 degrees) from a phase of the distal end of the left forward rotation auger. As a matter of course, the distal end of the right reverse rotation auger has a phase shifted 90 degrees (or substantially 90 degrees) from a phase of the distal end of the left reverse rotation auger.

As a result, snow delivered from the left forward rotation auger to the widthwise central portion of the auger housing and snow delivered from the right forward rotation auger to the widthwise central portion of the auger housing are controlled not to simultaneously intensively come to an inlet of the blower housing. Therefore, the snow delivered from the left and right forward rotation augers are efficiently forced into the inlet of the blower housing to achieve efficient snow removal. Furthermore, snow broken by the reverse rotation augers is smoothly delivered from the reverse rotation augers through the forward rotation augers into the blower. That is, the snow can be smoothly carried, thereby further enhancing the efficiency of snow-removing work.

DETAILED DESCRIPTION OF THE PREFERRED EMBODIMENT

A preferred embodiment of the present invention will hereinafter be described in detail below, by way of example only, with reference to the accompanying drawings, in which the reference signs Fr, Re, Le and Ri, respectively, denote a front side, a rear side, a left side and a right side, as viewed from an operator of an auger snow-removing machine 10 embodying the present invention. The terms "front", "rear", "left", "right", "upper", and "lower" indicates a forward direction, a rearward direction, a leftward direction, a rightward direction, an upward direction, and a downward direction, respectively, from the operator of the auger snow-removing machine 10.

Figure 1:
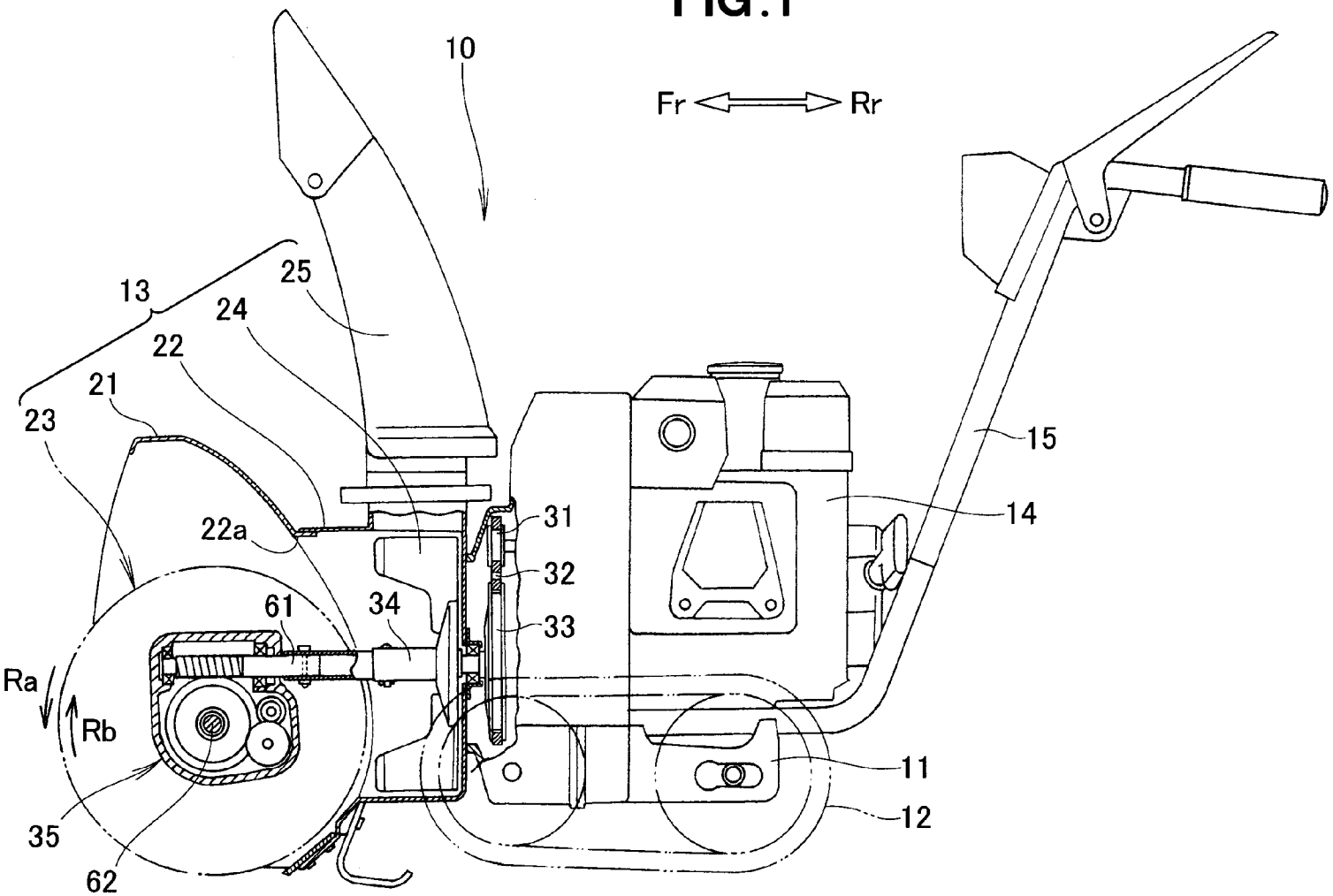
FIG. 1 is a side elevation view of an auger snow-removing machine according to the present invention.

An auger snow-removing machine in the preferred embodiment of the present invention is discussed below. As shown in FIG. 1, the auger snow-removing machine 10 is a self-propelled walk-behind snow-removing machine having a traveling unit 12, a snow-removing work unit 13, and a power source 14 that are mounted on a machine body (body frame) 11 with an operation handle 15 extending rearwardly from a rear part of the body frame 11. The operator can operate or maneuver the self-propelled walk-behind auger snow-removing machine (hereinafter referred to, for brevity, as "snow-removing machine 10") by operating the operation handle 15 while walking behind the snow-removing machine 10.

The snow removing work unit 13 includes an auger housing 21, a blower housing 22 provided behind the auger housing 21 at a widthwise central portion of the auger housing 21, an auger 23 disposed within the auger housing 21, a blower 24 disposed inside the blower housing 22, and a shooter 25 extending vertically upward from the blower housing 22.

The power source 14 is provided for driving the travelling unit 12 and the snow removing work unit 13, and constituted, for example, by an engine. Motive power from the power source 14 is transmitted to the blower 24 through a power transmission path formed jointly by a drive pulley 31, a power transmission belt 32, a driven pulley 33 and a transmission shaft 34. From the transmission shaft 34, the motive power from the power source 14 is also transmitted via a transmission 35 to the auger 23. With this arrangement, snow collected by the auger 23 is thrown by the blower 24 to a distant place oriented by the shooter 25. The travelling unit 12 may be a motor-driven traveling unit.

The snow-removing work unit 13 will be described in greater detail. The blower housing 22 is of tubular shape having a circle as viewed in front elevation and mounted to the machine body 11. The blower 24 is mounted on the transmission shaft 34. The transmission shaft 34 has a front end connected to an input shaft 61 of the transmission 35. The transmission 35 is disposed inside the auger housing 21.

Figure 2:
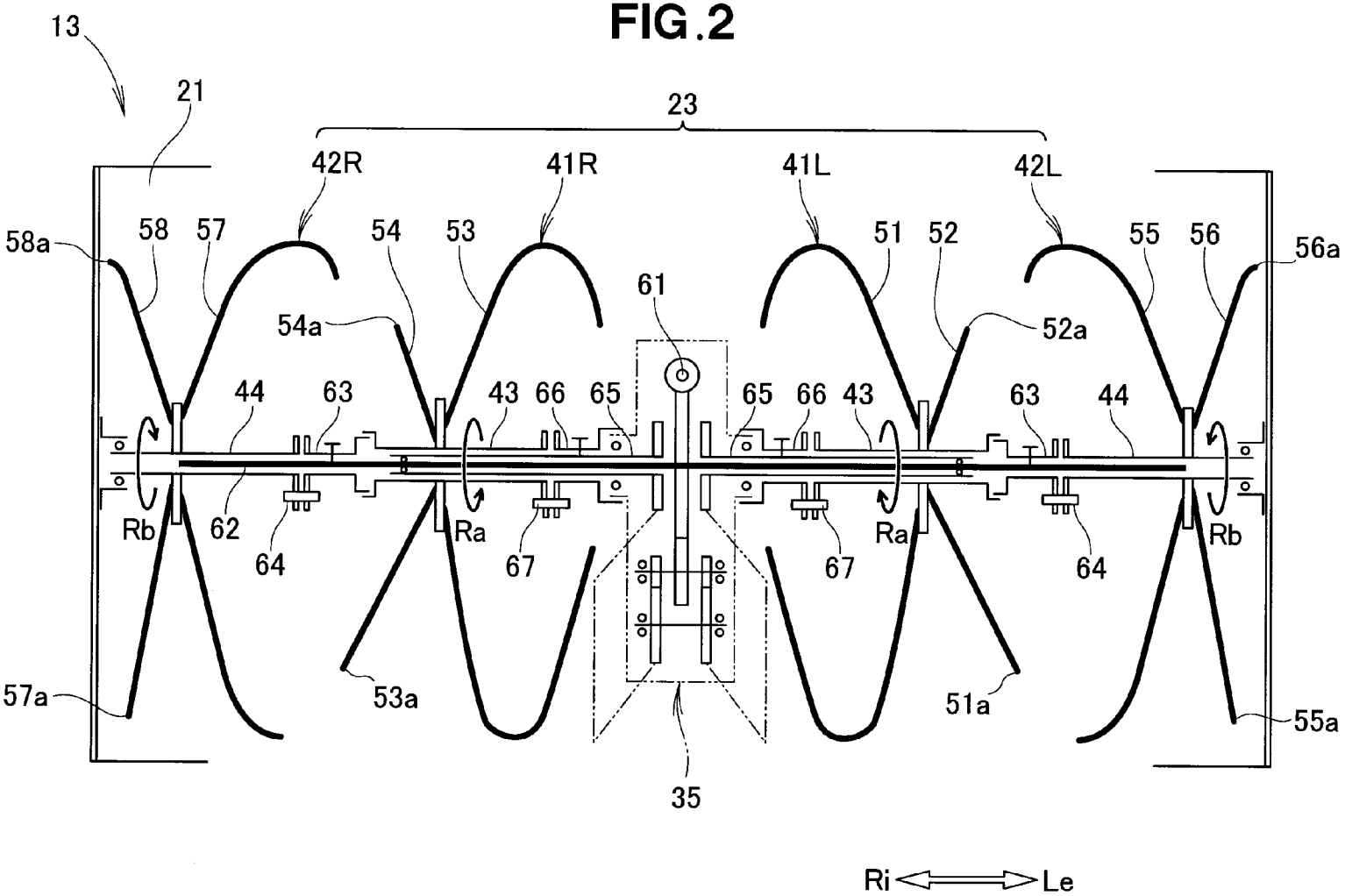
FIG. 2 is a diagrammatical view of an auger-driving system shown in FIG. 1 as the auger snow-removing machine is viewed in front elevation.
Figure 3:
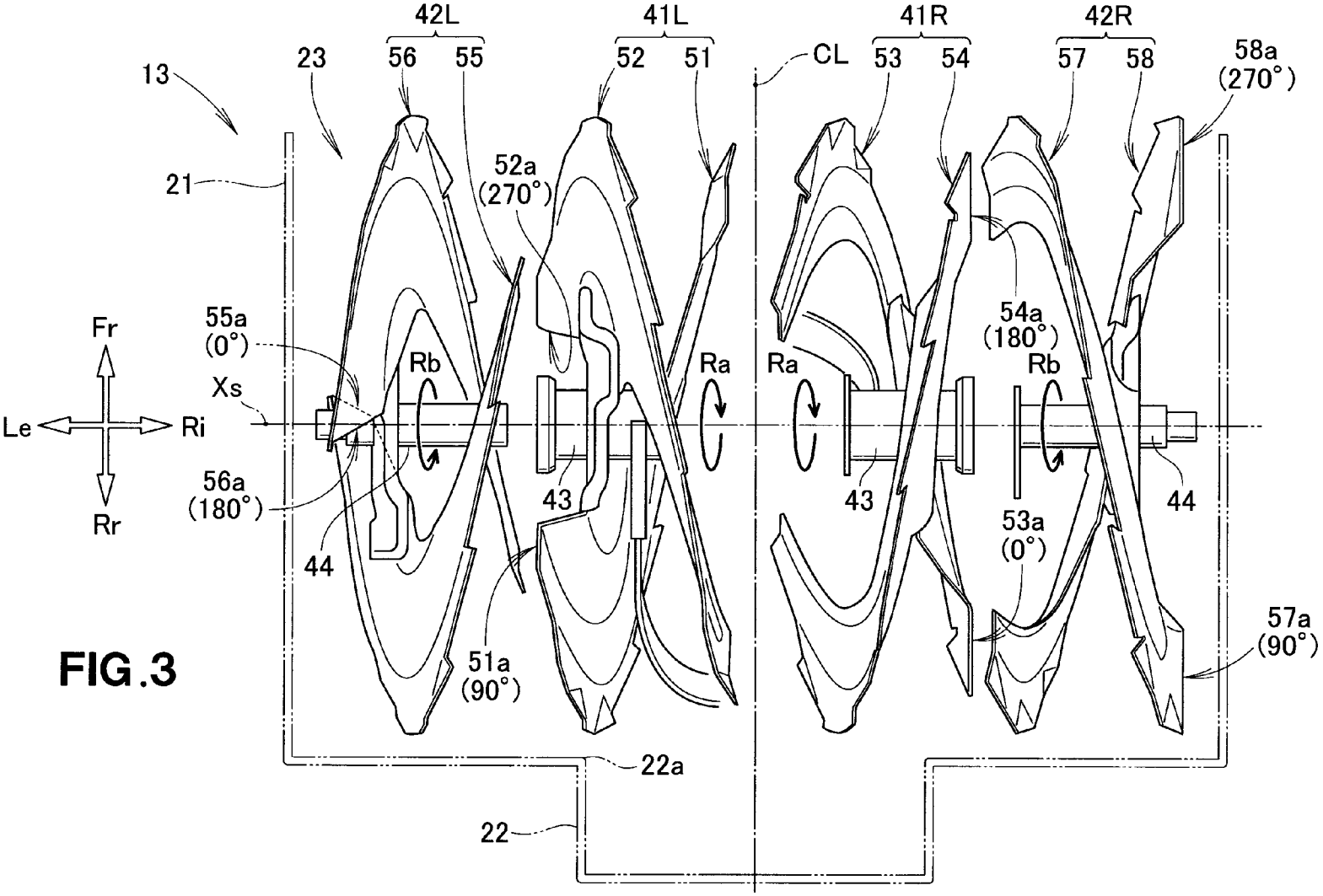
FIG. 3 is a plan view of an auger housing and an auger shown in FIG. 1.

As shown in FIGS. 2 and 3, the auger 23 is comprised of left and right forward rotation augers 41L, 41R adapted to rotate in a direction (indicated by an arrow Ra) from an upper side of the augers 41L, 41R toward a front lower side of the augers 41L, 41R while the snow-removing machine is in snow-removing operation, and left and right reverse rotation augers 42L, 42R adapted to rotate in a reverse direction (indicated by an arrow Rb) opposite to the direction of rotation of the left and right forward rotation augers 41L, 41R during the snow-removing operation of the snow-removing machine 10.

The left and right forward rotation augers 41L, 41R are located either inside or outside the left and right reverse rotation augers 42L, 42R in a width direction of the auger housing 21. For example, the left and right forward rotation augers 41L, 41R are located near the widthwise central portion of the auger housing 21 and close to each other with the transmission 35 on a widthwise center line CL being located therebetween. The left and right reverse rotation augers 42L, 42R are located on opposite widthwise sides of the auger housing 21. That is, the left and right reverse rotation augers 42L, 42R are located closer to widthwise outsides of the auger housing 21 than the left and right forward rotation augers 41L, 41R. The left forward rotation auger 41L and the left reverse rotation auger 42R are juxtaposed with each other in an axial direction of the auger 23. Similarly, the right forward rotation auger 41R and the right reverse rotation auger 42R are juxtaposed with each other in the axial direction of the auger 23.

With respect to the rotating direction of the auger 23 which will occur during snow-removing operation of the snow-removing machine 10, rotation in the direction from the upper side to the front lower side, i.e., in the direction of the arrow Ra (counterclockwise direction in FIG. 1) is hereinafter referred to as "forward rotation", and rotation in the direction opposite to the rotating direction of the left and right forward rotation augers 41L, 41R, i.e., in the direction of the arrow Rb (clockwise direction in FIG. 1) is hereinafter referred to as "reverse rotation".

The left and right forward rotation augers 41L, 41R are provided on left and right forward rotation shafts 43, 43, respectively. More specifically, each of the left and right forward rotation augers 41L, 41R is formed by a combination of two auger members. That is, the left forward rotation auger 41L is comprised of a first left forward rotation auger member 51 and a second left forward rotation auger member 52. The right forward rotation auger 41R is comprised of a first right forward rotation auger member 53 and a second right forward rotation auger member 54. Each of the forward rotation auger members 51 to 54 is a spiral-shaped strip-like member having a predetermined width. Each of the forward rotation auger members 51 to 54 has a spiral direction determined such that each of the forward rotation auger members 51 to 54 while undergoing forward rotation can collect or gather broken snow toward the widthwise central portion of the. auger housing 21.

The left and right reverse rotation augers 42L, 42R are provided on left and right reverse rotation shafts 44, 44, respectively. More specifically, each of the left and right reverse rotation augers 42L, 42R is formed by a combination of two auger members. That is, the left reverse rotation auger 42L is comprised of a first left reverse rotation auger member 55 and a second left reverse rotation auger member 56. The right reverse rotation auger 42R is comprised of a first right reverse rotation auger member 57 and a second right reverse rotation auger member 58. Each of the reverse rotation auger members 55 to 58 is a spiral-shaped strip-like member having a predetermined width. Each of the forward rotation auger members 55 to 58 has a spiral direction determined such that each of the reverse rotation auger members 55 to 58 while undergoing reverse rotation can collect or gather broken snow toward the widthwise central portion of the auger housing 21.

The left and right forward rotation shafts 43, 43 and the left and right reverse rotation shafts 44, 44 are disposed on the same axis (an axis Xs shown in FIG. 3) and aligned with one another in the width direction of the auger housing 21 within the auger housing 21. That is to say, the left and right forward rotation augers 41L, 41R and the left and right reverse rotation augers 42L, 42R are coaxially disposed (on the axis Xs shown in FIG. 3) and located at a front part of the body frame 11 (FIG. 1).

As shown in FIG. 2, the left and right reverse rotation shafts 44, 44 are constituted by pipe-shaped shafts relatively rotatably fitting over a reverse rotation drive shaft 62 of the transmission 35. The reverse rotation drive shaft 62 extends in the width direction of the auger housing 21. When a driving force is input to the input shaft 61, the reverse rotation drive shaft 62 can undergo reverse rotation. The reverse rotation drive shaft 62 has longitudinal opposite ends connected to left and right reverse rotation rotating shafts 63, 63. The left and right reverse rotation rotating shafts 63, 63 are connected to the left and right reverse rotation shafts 44, 44 by left and right reverse rotation shear bolts 64, 64.

Further, the transmission 35 has left and right forward rotation drive shafts 65, 65. The left and right forward rotation drive shafts 65, 65 are constituted by pipe-shaped shafts relatively rotatably fitting over the reverse rotation drive shaft 62 of the transmission 35. When a driving force is input to the input shaft 61, the forward rotation drive shafts 65, 65 can undergo forward rotation. The left and right forward rotation drive shafts 65, 65 are connected to left and right forward rotation rotating shafts 66, 66. The left and right forward rotation shafts 43, 43 are constituted by pipe-shaped shafts relatively rotatably fitting over the left and right forward rotation drive shafts 65, 65. The left and right forward rotation shafts 43, 43 are connected to the left and right forward rotation rotating shafts 66, 66 by left and right forward rotation shear bolts 67, 67.

As shown in FIG. 3, the left and right forward rotation augers 41L, 41R and the left and right reverse rotation augers 42L, 42R have the same outer diameter. The left and right forward rotation augers 41L, 41R and the left and right reverse rotation augers 42L, 42R have the same width (extending in the width direction of the auger housing 21). The left and right forward rotation augers 41L, 41R and the left and right reverse rotation augers 42L, 42R have the same rotational speed. That is, all of the augers 41L, 41R, 42L, 42R have the same rotational speed.

Snow broken by the left and right reverse rotation augers 42L, 42R is gathered toward the left and right forward rotation augers 41L, 41R. The gathered snow and snow broken by the left and right forward rotation augers 411, 41R are gathered at the widthwise central portion of the auger housing 21 and delivered into the rearward-located blower housing 22 by the forward rotation augers 41L, 41R. The snow delivered into the blower housing 22 is thrown far out of the shooter 25 by the blower 24 shown in FIG. 1.

Detailed discussion is made below as to the auger 23 with reference to FIG. 3 and FIG. 4. FIG. 3 shows the auger housing 21 and the auger 23 as they viewed from above. From FIG. 3, it is clear how phases of the respective auger members 51 to 58 interrelate.

Figure 4:
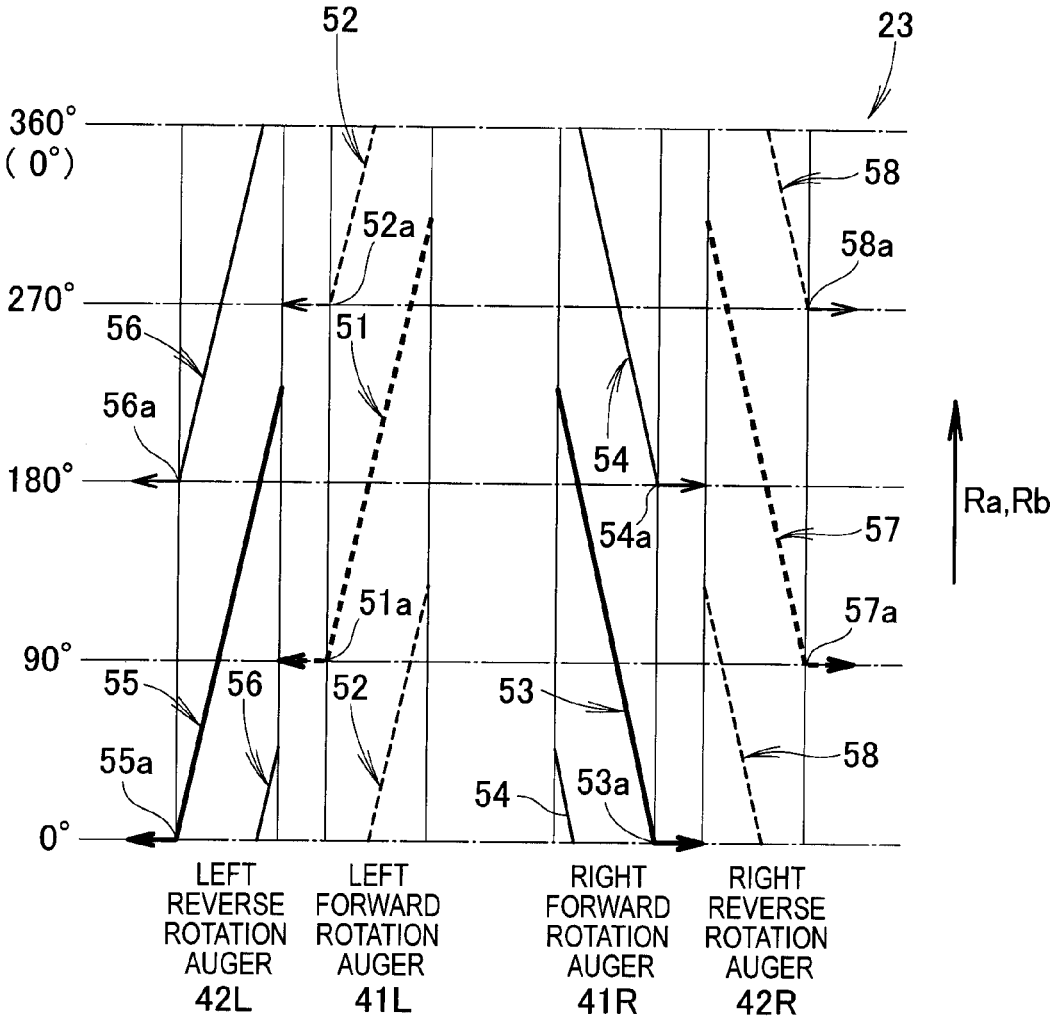
FIG. 4 is a view diagrammatically showing the auger shown in FIG. 3 as the augers are deployed.

FIG. 4 diagrammatically shows the auger 23 shown in FIG. 3 as the auger 23 is deployed. FIG. 4 shows a horizontal axis along which the left and right forward rotation augers 41L, 41R and the left and right reverse rotation augers 42L, 42R are arranged in a horizontal row in correspondence to those shown in FIG. 3. FIG. 4 also shows a vertical axis along which the left and right forward rotation augers 41L, 41R and the left and right reverse rotation augers 42L, 42R are deployed in a peripheral direction from a reference point of 0 degree to a point of 360 degrees. It is noted that the reference point of 0 degree is any one point in the direction of deployment of the auger for the purpose of illustration.

For a better understanding, in FIG. 4, spiral and rotational directions of the left and right reverse rotation augers 42L, 42R are opposite to those of the augers 42L, 42R shown in FIG. 3 relative to the left and right forward rotation augers 41L, 41R. That is, in FIG. 4, the direction of deployment of the left and right reverse rotation augers 42L, 42R conforms to the direction of deployment of the left and right forward rotation augers 41L, 41R. Also, the rotational direction Rb of the left and right reverse rotation augers 42L, 42R conforms to the rotational direction Ra of the left and right forward rotation augers 41L, 41R.

As shown in FIG. 4, each of the left and right forward rotation auger members 51 to 54 and the left and right reverse rotation augers 55 to 58 has a deployment angle (an angle in the rotational direction) of 225 degrees. As shown in FIG. 3 and FIG. 4, a phase relationship among the respective auger members 51 to 58 is as follows.

The first right forward rotation auger member 53 has a distal end 53*a* in the rotational direction Ra. The first left reverse rotation auger member 55 has a distal end 55*a* in the rotational direction Rb. The distal end 53*a* of the first right forward rotation auger member 53 and the distal end 55*a* of the first left reverse rotation auger member 55 are located at the reference point of 0 degree (phase of 0 degree) in the deployment direction. In other words, the distal end 53*a* and the distal end 55*a* have their phases set such that the distal end 53*a* and the distal end 55*a* substantially simultaneously reach a lowermost location (e.g., a surface of accumulated snow to be removed) when the distal ends 53*a*, 55*a* revolve or rotate in the opposite directions.

The first left forward rotation auger member 51 has a distal end 51*a* in the rotational direction Ra. The first right reverse rotation auger member 57 has a distal end 57*a* in the rotational direction Rb. The distal end 51*a* of the first left forward rotation auger member 51 and the distal end 57*a* of the first right reverse rotation auger member 57 are located at the reference point of 90 degrees (phase of 90 degrees) in the deployment direction. In other words, the distal end 51*a* and the distal end 57*a* have their phases set such that the distal end 51*a* and the distal end 57*a* substantially simultaneously reach the lowermost location (e.g., the surface of accumulated snow to be removed) when the distal ends 51*a*, 57*a* revolve or rotate in the opposite directions.

The second right forward rotation auger member 54 has a distal end 54*a* in the rotational direction Ra. The second left reverse rotation auger member 56 has a distal end 56*a* in the rotational direction Rb. The distal end 54*a* of the second right forward rotation auger member 54 and the distal end 56*a* of the second left reverse rotation auger member 56 are located at the reference point of 180 degrees (phase of 180 degrees) in the deployment direction. In other words, the distal end 54*a* and the distal end 56*a* have their phases set such that the distal end 54*a* and the distal end 56*a* substantially simultaneously reach the lowermost location (e.g., the surface of accumulated snow to be removed) when the distal ends 54*a*, 56*a* revolve or rotate in the opposite directions.

The second left forward rotation auger member 52 has a distal end 52*a* in the rotational direction Ra. The second right reverse rotation auger member 58 has a distal end 58*a* in the rotational direction Rb. The distal end 52*a* of the second left forward rotation auger member 52 and the distal end 58*a* of the second right reverse rotation auger member 58 are located at the reference point of 270 degrees (phase of 270 degrees) in the deployment direction. Thus, the distal end 52*a* and the distal end 58*a* have their phases set such that the distal end 52*a* and the distal end 58*a* substantially simultaneously reach the lowermost location (e.g., the surface of accumulated snow to be removed) when the distal ends 52*a*, 58*a* revolve or rotate in the opposite directions.

That is, the phase of the distal end 52*a* of the second left forward rotation auger member 52 is 270 degrees, which phase is shifted 180 degrees from the phase of 90 degrees of the distal end 51*a* of the first left forward rotation auger member 51 in the rotational direction Ra.

The phase of the distal end 54*a* of the second right forward rotation auger member 54 is 180 degrees, which phase is shifted 180 degrees from the phase of 0 degree of the distal end 53*a* of the first right forward rotation auger member 53 in the rotational direction Ra.

The distal ends 53*a*, 54*a* of the right forward rotation auger 41R have their phases shifted 90 degrees (or substantially 90 degrees) from the phases of the distal ends 51*a*, 52*a* of the left forward rotation auger 41L, respectively.

The phase of the distal end 56*a* of the second left reverse rotation auger member 56 is 180 degrees, which phase is shifted 180 degrees from the phase of 0 degree of the distal end 55*a* of the first left reverse rotation auger member 55 in the rotational direction Rb.

The phase of the distal end 58*a* of the second right reverse rotation auger member 58 is 270 degrees, which phase is shifted 180 degrees from the phase of 90 degrees of the distal end 57*a* of the first right reverse rotation auger member 57 in the rotational direction Rb.

The distal ends 57*a*, 58*a* of the right reverse rotation auger 42R have their phases shifted 90 degrees (or substantially 90 degrees) from the phases of the distal ends 55*a*, 56*a* of the left reverse rotation auger 42L, respectively.

Thus, the distal ends 51*a*, 52*a* of the left forward rotation auger 41L in the rotational direction Ra and the distal ends 57*a*, 58*a* of the right reverse rotation auger 42R in the rotational direction Rb have the phases set such that the distal ends 51*a*, 52*a* reach the lowermost location (e.g., the surface of the accumulated snow) substantially at the same time as the distal ends 57*a*, 58*a*, respectively, when the left forward rotation auger 41L rotates in the direction Ra and the right reverse rotation auger 42R rotates in the direction Rb.

The distal ends 53*a*, 54*a* of the right forward rotation auger 41R in the rotational direction Ra and the distal ends 55*a*, 56*a* of the left reverse rotation auger 42L in the rotational direction Rb have the phases set such that the distal ends 53*a*, 54*a* reach the lowermost location (e.g., the surface of the accumulated snow) substantially at the same time as the distal ends 55*a*, 56*a*, respectively, when the right forward rotation auger 41R rotates in the direction Ra and the left reverse rotation auger 42L rotates in the direction Rb.

The foregoing description is summarized as follows.

The left and right forward rotation augers 41L, 41R rotatable in the direction from the upper side to the front lower side during snow-removing operation of the snow-removing machine 10, and the left and right reverse rotation augers 42L, 42R rotatable in the reverse direction opposite to the direction of rotation of the left and right forward rotation augers 41L, 41R during the snow-removing operation are disposed on the same axis and aligned with one another in the width direction of the auger housing 21 within the auger housing 21, and are located at the front part of the body frame 11.

All of the augers 41L, 41R, 42L, 42R have the same rotational speed. The left and right forward rotation augers 41L, 41R are located either inside or outside the left and right reverse rotation augers 42L, 42R in the width direction of the auger housing 21. The distal ends 51*a*, 52*a* of the left forward rotation auger 41L and the distal ends 57*a*, 58*a* of the right reverse rotation auger 42R have the phases set such that the distal ends 51*a*, 52*a* reach the lowermost location substantially at the same time as the distal ends 57*a*, 58*a*, respectively, when the left forward rotation auger 41L rotates in the direction Ra and the right reverse rotation auger 42R rotates in the direction Rb. Thus, the distal ends 51*a*, 52*a* of the left forward rotation auger 41L hit a surface of accumulated snow basically simultaneously with the distal ends 57*a*, 58*a* of the right reverse rotation auger 42R, respectively. Therefore, a reaction force exerted on the left forward rotation auger 41L during the snow-removing operation is counterbalanced by a reaction force exerted on the right reverse rotation auger 42R.

The distal ends 53*a*, 54*a* of the right forward rotation auger 41R and the distal ends 55*a*, 56*a* of the left reverse rotation auger 42L have the phases set such that the distal ends 53*a*, 54*a* reach the lowermost location substantially at the same time as the distal ends 55*a*, 56*a*, respectively, when the right forward rotation auger 41R rotates in the direction Ra and the left reverse rotation auger 42L rotates in the direction Rb. Thus, the distal ends 53*a*, 54*a* of the right forward rotation auger 41R hit a surface of accumulated snow basically simultaneously with the distal ends 55*a*, 56*a* of the left reverse rotation auger 42L, respectively. Therefore, a reaction force exerted on the right forward rotation auger 41R during the snow-removing operation is counterbalanced by a reaction force exerted on the left reverse rotation auger 42L.

The distal ends 57*a*, 58*a* of the right reverse rotation auger 42R are the same in phase as the distal ends 51*a*, 52*a* of the left forward rotation auger 41L, respectively, while the distal ends 55*a*, 56*a* of the left reverse rotation auger 42L are the same in phase as the distal ends 53*a*, 54*a* of the right forward rotation auger 41R, respectively. As a result, it becomes possible to inhibit an "unruliness phenomenon", i.e., inhibit the auger housing 21 or the body frame 11 from frequently swaying up and down and/or from side to side due to individual reaction forces exerted on the respective augers 41L, 41R, 42L, 42R during snow-removing operation of the snow-removing machine 10. Additionally, the left and right reverse rotation augers 42L, 42R inhibit lifting phenomena of the left and right forward rotation augers 41L, 41R. As a result, a running stability of the snow-removing machine 10 and an efficiency of snow removing work can be enhanced.

The blower housing 22 is provided behind the auger housing 21 at the widthwise central portion of the auger housing 21. The blower 24 is disposed inside the blower housing 22.

The phases of the distal ends 53*a*, 54*a* of the right forward rotation auger 41R are shifted 90 degrees (or substantially 90 degrees) from the phases of the distal ends 51*a*, 52*a* of the left forward rotation auger 41L, respectively. As a matter of course, the phases of the distal ends 57*a*, 58*a* of the right reverse rotation auger 42R are shifted 90 degrees (or substantially 90 degrees) from the phases of the distal ends 55*a*, 56*a* of the left reverse rotation auger 42L, respectively.

As a result, snow delivered from the left forward rotation auger 41L to the widthwise central portion of the auger housing 21 and snow delivered from the right forward rotation auger 41R to the widthwise central portion of the auger housing 21 are controlled not to simultaneously intensively come to an inlet 22*a* of the blower housing 22. Therefore, the snow delivered from the left and right forward rotation augers 41L, 41R are efficiently forced into the inlet 22*a* of the blower housing 22 to achieve efficient snow removal. Furthermore, snow broken by the reverse rotation augers 42L, 42R is smoothly delivered from the reverse rotation augers 42L, 42R through the forward rotation augers 41L, 41R into the blower 24. That is, the snow can be smoothly carried, thereby further enhancing the efficiency of snow-removing work.

The present invention is preferably applicable to a snow-removing machine having augers driven at least by an engine.

Obviously, various minor changes and modifications of the present invention are possible in the light of the above teaching. It is therefore to be understood that within the scope of the appended claims the invention may be practiced otherwise than as specifically described.

What is claimed is:

1. An auger snow-removing machine comprising:

left and right forward rotation augers rotatable in a direction from an upper side of the forward rotation augers toward a front lower side of the forward rotation augers during a snow-removing operation of the machine;

left and right reverse rotation augers rotatable in a reverse direction opposite to the direction of rotation of the left and right forward rotation augers during the snow-removing operation;

an auger housing;

a blower housing disposed behind the auger housing at a widthwise central portion of the auger housing; and a blower disposed inside the blower housing, the left and right forward rotation augers and the left and right reverse rotation augers being coaxially disposed and aligned with one another in a width direction of the auger housing within the auger housing, all of the left and right forward rotation augers and the left and right reverse rotation augers having the same rotational speed, the left and right forward rotation augers being located either inside or outside the left and right reverse rotation augers in the width direction of the auger housing, each of the left and right forward rotation augers and the left and right reverse rotation augers being formed by a combination of two spiral-shaped strip-like auger members, each of the auger members having a spiral direction such that the forward rotation augers, while undergoing forward rotation, collect snow toward the widthwise central portion of the auger housing and the reverse rotation augers, while undergoing reverse rotation, collect snow toward the widthwise central portion of the auger housing, the left forward rotation auger having a distal end in the direction of rotation of the left and right forward rotation augers, the right reverse rotation auger having a distal end in the direction of rotation of the left and right reverse rotation augers, the distal end of the left forward rotation auger and the distal end of the right reverse rotation auger having phases set such that the distal end of the left forward rotation auger and the distal end of the right reverse rotation auger substantially simultaneously reach a lowermost location when the left forward rotation auger and the right reverse rotation auger rotate, the right forward rotation auger having a distal end in the direction of rotation of the left and right forward rotation augers, the left reverse rotation auger having a distal end in the direction of rotation of the left and right reverse rotation augers, the distal end of the right forward rotation auger and the distal end of the left reverse rotation auger having phases set such that the distal end of the right forward rotation auger and the distal end of the left reverse rotation auger substantially simultaneously reach the lowermost location when the right forward rotation auger and the left reverse rotation auger rotate, and the distal end of the right forward rotation auger having a phase shifted 90 degrees from a phase of the distal end of the left forward rotation auger.

* * * * *